US005475948A

United States Patent [19]

Parke

[11] Patent Number: 5,475,948

[45] Date of Patent: Dec. 19, 1995

[54] METHOD OF SEALING A LOWER EDGE OF A DOOR

[76] Inventor: Richard G. Parke, Box 801, Nisku, Alberta, Canada, T0C 2G0

[21] Appl. No.: 370,373

[22] Filed: Jan. 9, 1995

[51] Int. Cl.[6] ..... E06B 3/00

[52] U.S. Cl. ..... 49/506; 49/470; 49/490.1; 49/495.1; 49/500.1

[58] Field of Search ..... 49/470, 495.1, 49/500.1, 490.1, 475.1, 506

[56] References Cited

U.S. PATENT DOCUMENTS

| | | | |
|---|---|---|---|
| 1,625,764 | 4/1927 | Bosley | 49/495.1 X |
| 2,347,158 | 4/1944 | Spraragen | 49/500.1 X |
| 2,560,308 | 7/1951 | Sparagen | 49/495.1 |
| 2,592,861 | 4/1952 | Close | 49/495.1 X |
| 2,738,559 | 3/1956 | Edwards, Jr. | 49/495.1 |
| 4,765,094 | 8/1988 | Gemmell | 49/475.1 |

FOREIGN PATENT DOCUMENTS

| | | | |
|---|---|---|---|
| 2238069 | 5/1991 | United Kingdom | 49/470 |

*Primary Examiner*—Philip C. Kannan
*Attorney, Agent, or Firm*—Anthony R. Lambert

[57] ABSTRACT

An apparatus for sealing an edge of a door is described which includes a first elongate sealing element and a second elongate sealing element in parallel spaced relation to the first elongate sealing element. At least one connective member connects the first elongate sealing element and the second elongate sealing element in parallel spaced relation.

1 Claim, 3 Drawing Sheets

METHOD OF SEALING A LOWER EDGE OF A DOOR

FIELD OF THE INVENTION

The present invention relates to an apparatus for sealing an edge of a door, and a preferred method of use for said apparatus.

BACKGROUND OF THE INVENTION

U.S. Pat. No. 5,214,880 which issued to Woodruff et al in 1993 and U.S. Pat. No. 5,168,669 which issued to Knapp in 1992 are representative of apparatus that are used for sealing an edge of a door. Both of the references disclose generally "U" shaped bodies that are secured to a bottom edge of a door. Each of the "U" shaped bodies has a plurality of depending fins which extend downwardly to engage a threshold below a door. However, a disadvantage with sealing apparatus constructed in accordance with the teachings of Woodruff et al or Knapp is that screws must be inserted into a face of the door in order to attach the "U" shaped bodies in an operative position.

PCT Application PCT/AU92/00249 filed by Howe and published in 1993 discloses a form of seal that is affixed to a bottom of a door with bonding tapes. The seal extends downwardly to engage a threshold of a door. The sealing apparatus disclosed by Howe does not visibly mark the face of a door, however, it is not suited for all installations. For example, over time an overhead garage becomes somewhat bowed. With a bowed garage door the gaps to be sealed at peripheral edges of the door are larger than the gap to be sealed near the center of the door. The result is that when the Howe apparatus is effectively sealing the gap near the center of the door, it is only partially covers the gap at the peripheral edges.

SUMMARY OF THE INVENTION

What is required is an alternate form of apparatus for sealing an edge of a door.

According to one aspect of the present invention there is provided an apparatus for sealing an edge of a door which includes a first elongate sealing element and a second elongate sealing element in parallel spaced relation to the first elongate sealing element. At least one connective member connects the first elongate sealing element and the second elongate sealing element in parallel spaced relation.

The sealing apparatus, as described above, can be attached by various means to an edge of a door. For example a lower edge of a bowed garage door. When so attached, the bowed garage door can be lowered until its central portion rests on a groundsurface. If the sealing elements were affixed to the bottom of the door, as is taught in the prior art, gaps would inevitably be left at the bottom of the door at each of peripheral extremities of the door. However, with the sealing apparatus, as described above, the sealing elements are positioned on opposite sides of the door and are free to hang down until they reach the groundsurface. At the central portion of the door, where door rests upon the groundsurface and the gap is negligible, the sealing element will be positioned substantially parallel with the bottom of the door. At the peripheral extremities, where the gap is much larger, the sealing elements will hang down until they rest upon the groundsurface to complete the seal. As the sealing elements are positioned on both the first side and the second side of the door, an air pocket is formed inbetween. It will be appreciated that in order to ensure a complete seal the first elongate sealing element and the second elongate sealing element should be of a length which approximates the width of a door to which the respective sealing elements are to be fitted. It will also be appreciated that the spacing between the first elongate sealing element and the second elongate sealing element should be substantially equal to the thickness of a door to which the respective sealing elements are to be fitted so they are positioned immediately adjacent the door. A generally cylindrical shape is preferred, but other shapes could be used to like effect. It is preferred that the connective member be in the form of a web that extends the length of the respective sealing elements. A series of straps spaced at intervals along the length of the respective sealing elements would be serviceable as long as greater care were taken to prevent gaps between the sealing elements and the door.

Although beneficial results may be obtained through the use of the apparatus, as described above, the apparatus has a marked advantage when avoiding damage to the door is of paramount concern. According to another aspect of the present invention there is provided a method of sealing a lower edge of a door. Firstly, provide a first elongate sealing element and a second elongate sealing element. The first elongate sealing element and the second elongate sealing element are connected in parallel spaced relation by at least one connective member. The first elongate sealing element and the second elongate sealing element are of a length which approximate a width of a door to which the respective sealing elements are to be fitted. The spacing between the first elongate sealing element and the second elongate sealing element is substantially equal to a thickness of the door to which the respective sealing elements are to be fitted. Secondly, slide the connective member beneath a lower edge of the door with the first elongate sealing element positioned adjacent the lower edge on a first side of the door and the second elongate sealing element positioned adjacent the lower edge on the second side of the door. The first elongate sealing element and the second elongate sealing element are maintained in position solely by their relative positioning to the door unfettered by fasteners. Both the first elongate sealing element and the second elongate sealing element are larger than the distance between the lower edge of the door and a floor. When the door is moved in a first direction the door pushes the first elongate sealing element along the floor which moves dragging behind the second elongate sealing element. When the door is moved in a second direction the door pushes the second elongate sealing element along the floor which moves dragging behind the first elongate sealing element.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
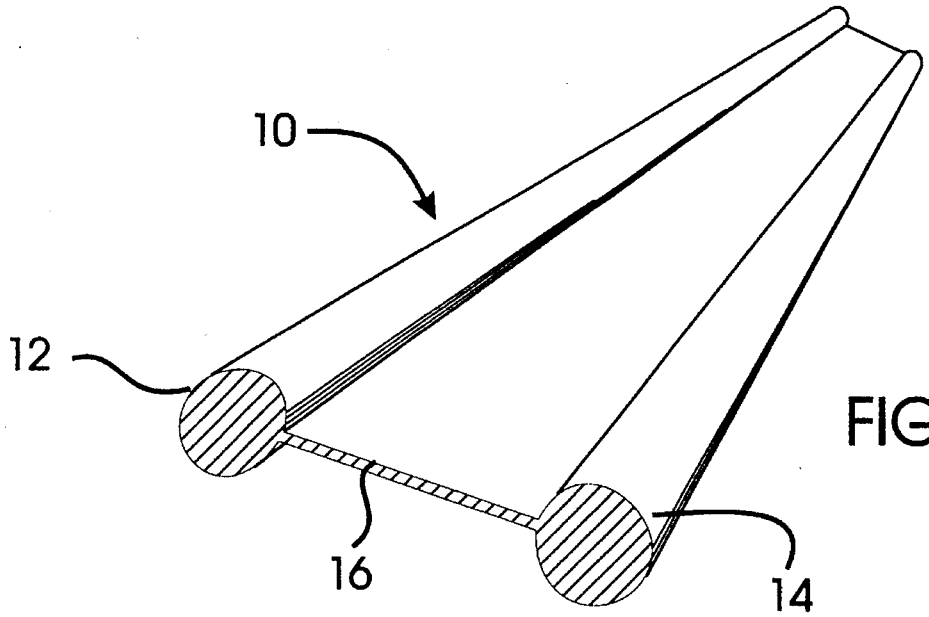
FIG. 1 is a perspective view of an apparatus for sealing an edge of a door constructed in accordance with the teachings of the present invention.

The preferred embodiment, an apparatus for sealing an edge of a door generally identified by reference numeral 10, will now be described with reference to FIGS. 1 through 6.

Referring to FIG. 1, apparatus 10 includes a first elongate cylindrical sealing element 12 and a second elongate cylindrical sealing element 14. A web-form connective member 16 extends the length of first elongate sealing element 12 and second elongate sealing element 14. Connective member 16 connects first elongate sealing element 12 and second elongate sealing element 14 and maintains them in parallel spaced relation.

Figure 2:
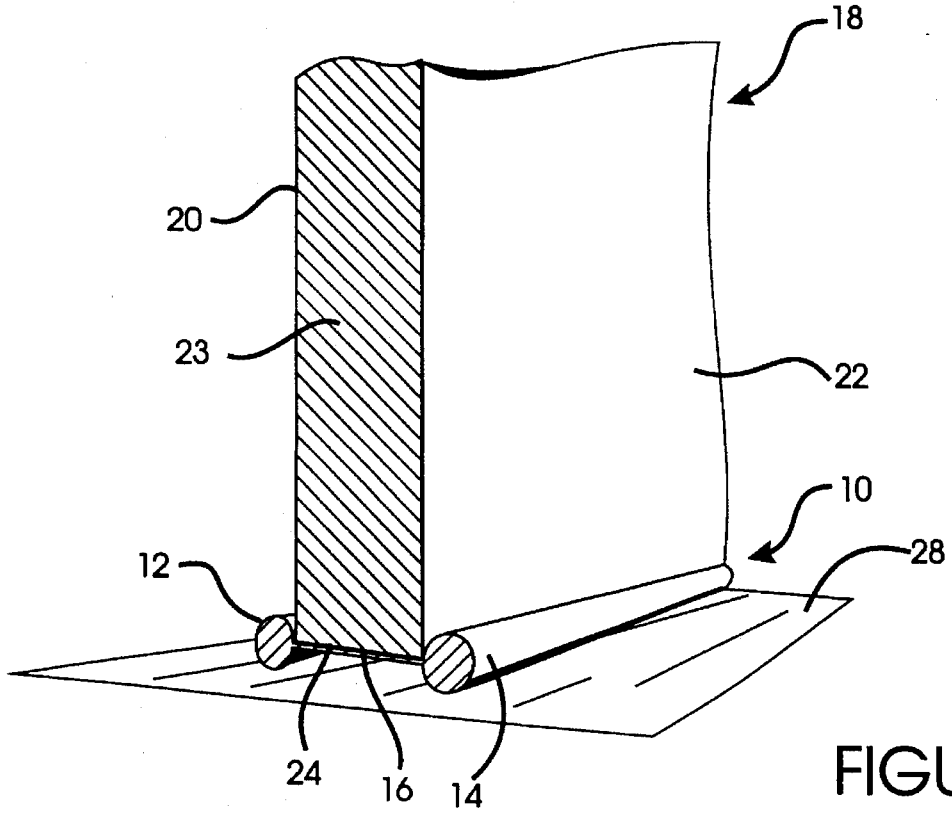
FIG. 2 is a side elevation view of the apparatus illustrated in FIG. 1 positioned on a door.
Figure 3:
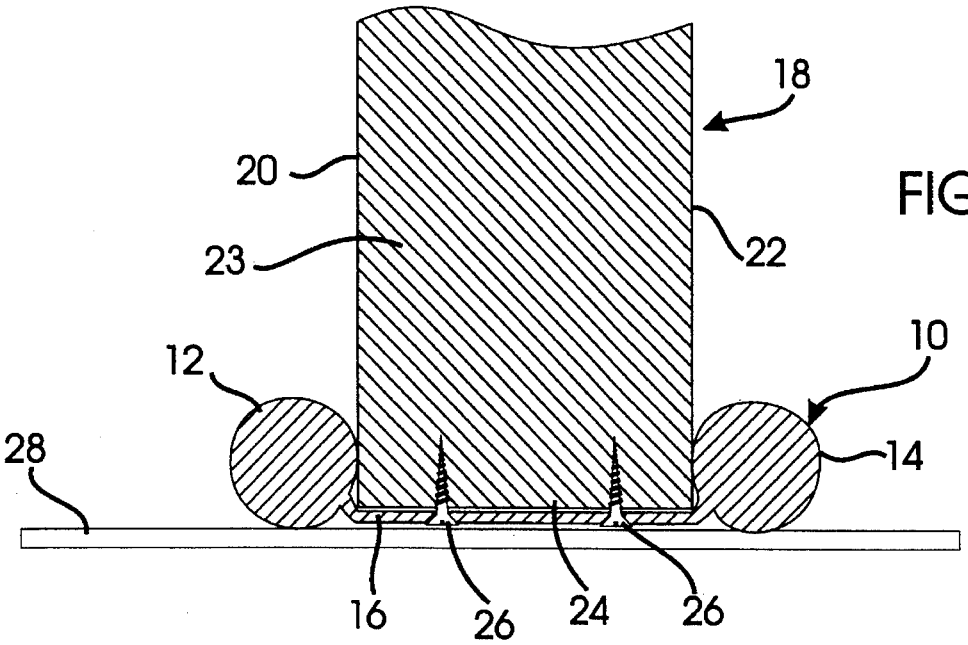
FIG. 3 is a first end elevation view of the apparatus illustrated in FIG. 2.
Figure 4:
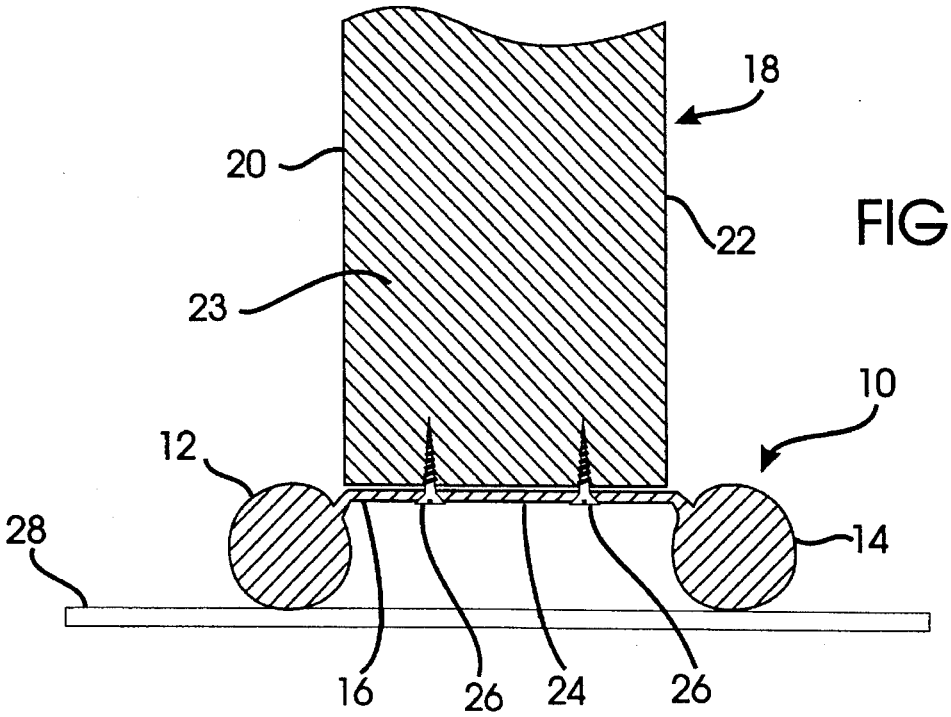
FIG. 4 is a first end elevation view of the apparatus illustrated in FIG. 2.
Figure 5:
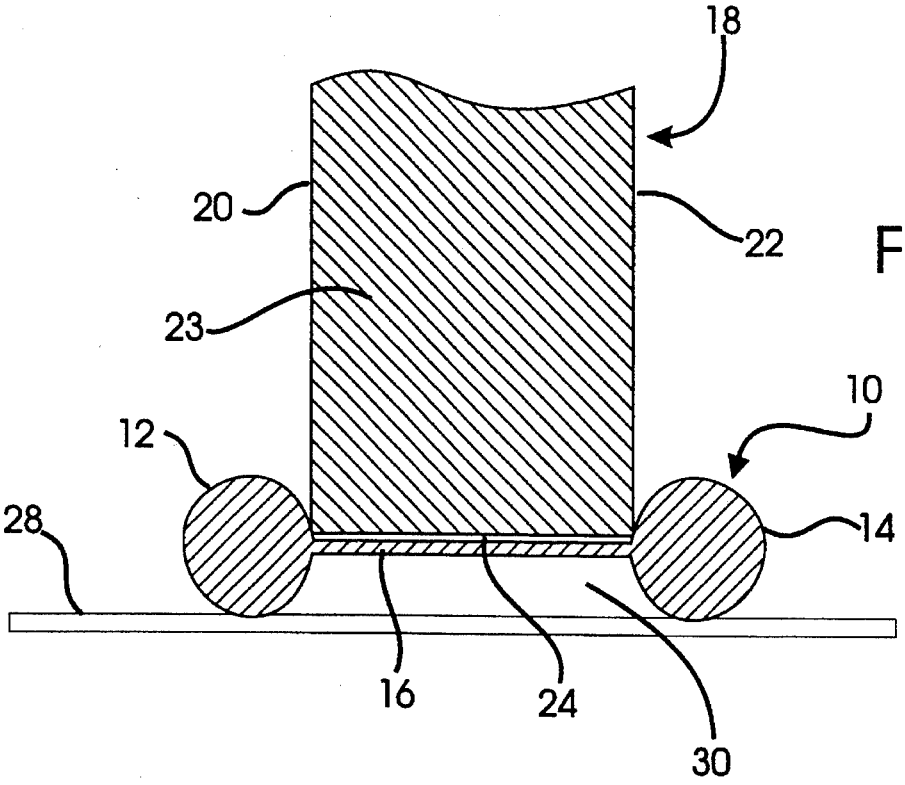
FIG. 5 is a second end elevation view of the apparatus illustrated in FIG. 2.
Figure 6:
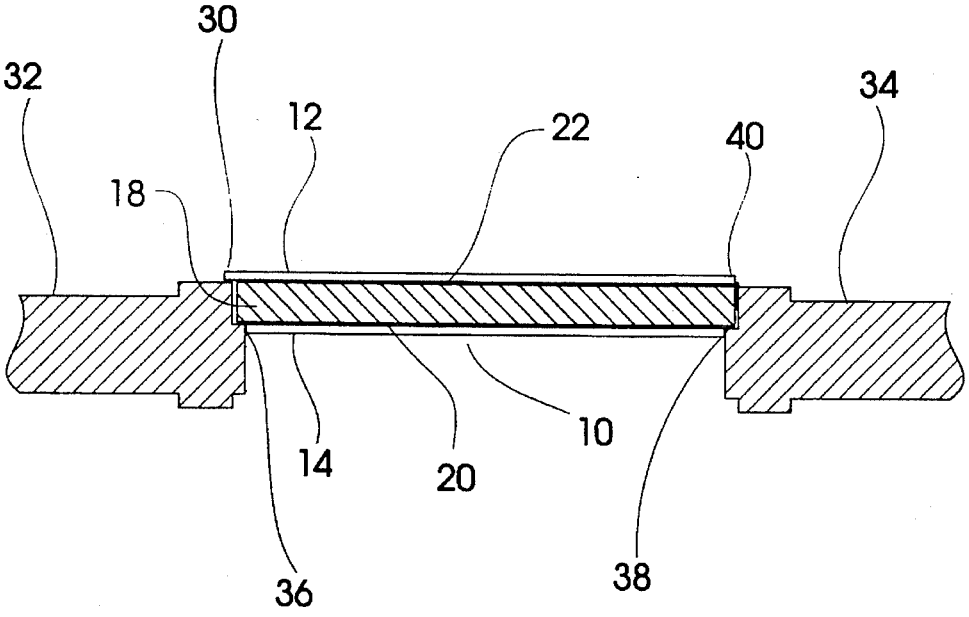
FIG. 6 is a top plan view in section of the apparatus illustrated in FIG. 2.

Referring to FIGS. 2 through 6, a door 18 is illustrated. Referring to FIGS. 2 through 5, door 18 has a first side 20, a second side 22, a vertical edge 23 and a lower edge 24. Referring to FIG. 5, it is preferred that the spacing between first elongate sealing element 12 and second elongate sealing element 14 as provided by connective member 16 be substantially equal to the thickness of door 18. Referring to FIGS. 2 and 6, it is preferred that first elongate sealing element 12 and second elongate sealing element 14 be of a length which approximate the width of door 18. Referring to FIG. 6, there is illustrated a left side door jamb 32 and a right side door jamb 34. It should be noted that when door 18 cooperates with door jambs 32 and 34 a number of peripheral sealing points 30, 36, 38, and 40 are created dependent upon the profile of door jambs 32 and 34. For this reason the length of first elongate sealing element 12 and second elongate sealing element 14 approximate but are not necessarily exactly equal to the width of door 18. It should be noted that at sealing point 30 first elongate sealing element 12 extends slightly beyond the width dimension of door 18. It should also be noted that at sealing points 36 and 38 second elongate sealing element 14 is slightly less than the width dimension of door 18 in order to provide a tight seal with left door jamb 32 and right door jamb 34, respectively.

The use and operation of apparatus 10 will now be described firstly in relation to an installation that involves physical attachment to one of vertical edge 23 or lower edge 24 and secondly in relation to an installation in which physical attachment is not required. Referring to FIGS. 3 and 4, there is illustrated the manner in which apparatus 10 is intended to function when door 18 is an overhead door that is raised vertically. In such an installation, connective member 16 is secured to lower edge 24 of door 18 by fasteners 26. Care is taken to ensure that first elongate sealing element 12 is positioned adjacent lower edge 24 on first side 20 of door 18 and that second elongate sealing element 14 is positioned adjacent lower edge 22 on second side 22 of door 18. In FIGS. 3 and 4, door 18 is shown as having been lowered toward a floor or groundsurface 28. Referring to FIG. 3, in those areas where the gap to be sealed is small sealing elements 12 and 14 are compressed and pushed to first side 20 and second side 22, respectively, of door 18. Referring to FIG. 4, in those areas where the gap to be sealed is larger, connective member 16 flexes to permit first elongate sealing element 12 and second elongate sealing element 14 to depend downwardly until they rest upon floor or groundsurface 28. An insulating air pocket 30 is formed between first elongate sealing element 12 and second elongate sealing element 14. It will be appreciated that in order to form an effective seal both first elongate sealing element 12 and second elongate sealing element 14 must be larger than the greatest distance between lower edge 24 of door 18 and floor or groundsurface 28.

Referring to FIG. 5, a different methodology is illustrated the primarily applies to interior doors 18 which swing on hinges. In such cases the installation merely consists of sliding connective member 16 beneath lower edge 24 of door 18. As previously described, first elongate sealing element 12 is positioned adjacent lower edge 24 on first side 20 of door 18 and second elongate sealing element 14 is positioned adjacent lower edge 24 on second side 22 of door 18. With this installation first elongate sealing element 12 and second elongate sealing element 14 are maintained in position solely by their positioning relative to door 18, unfettered by fasteners of any kind. As before first elongate sealing element 12 and second elongate sealing element 14 should be larger than the greatest distance between lower edge 24 of door 18 and floor or groundsurface 28. When door 18 is moved in a first direction, door 18 pushes first elongate sealing element 12 along floor or groundsurface 28. First elongate sealing element 12 moves in response to the force exerted by door 18 dragging behind second elongate sealing element 14. Conversely, when door 18 is moved in a second direction, door 18 pushes second elongate sealing element 14 along floor or groundsurface 28. Second elongate sealing element 14 moves in response to the force exerted by door 18 dragging behind first elongate sealing element 12.

It will be apparent to one skilled in the art that modifications may be made to the illustrated embodiment without departing from the spirit and scope of the invention as hereinafter defined in the claims. In particular, it will be appreciated that when door 18 swings on hinges, there are a variety of alternate forms for connective member 16 that would be equally serviceable. It will also be appreciated that although a cylindrical shape slides most readily along floor or groundsurface 28, there are other shapes that are serviceable. It will finally be appreciated that the teachings of the present invention can be adapted for physical attachment to vertical edge 23 of door 18.

The embodiments of the invention in which an exclusive property or privilege is claimed are defined as follows:

1. A method of sealing a lower edge of a door, comprising the steps of:

providing a first elongate sealing element and a second elongate sealing element, the first elongate sealing element and the second elongate sealing element being connected in parallel spaced relation by at least one connective member, the first elongate sealing element and the second elongate sealing element being of a length which approximates the width of a door to which the respective sealing elements are to be fitted, the spacing between the first elongate sealing element and the second elongate sealing element being substantially equal to the thickness of the door to which the respective sealing elements are to be fitted;

sliding the connective member beneath a lower edge of the door with the first elongate sealing element positioned adjacent the lower edge on a first side of the door and the second elongate sealing element positioned adjacent the lower edge on the second side of the door, the first elongate sealing element and the second elongate sealing element being maintained in position solely by their relative positioning to the door unfettered by fasteners, both the first elongate sealing element and the second elongate sealing element being larger than the distance between the lower edge of the door and a floor such that when the door is moved in a first direction the door pushes the first elongate sealing element along the floor which moves dragging behind the second elongate sealing element, and when the door is moved in a second direction the door pushes the second elongate sealing element along the floor which moves dragging behind the first elongate sealing element.

* * * * *